United States Patent [19]

Brian

[11] Patent Number: 4,974,264

[45] Date of Patent: Dec. 4, 1990

[54] MANUALLY OPERATED VACUUM FLUSH WATER CLOSET

[76] Inventor: Michael Brian, 5540 Shore Dr., Orchard Lake, Mich. 48033

[21] Appl. No.: 325,946

[22] Filed: Mar. 20, 1989

[51] Int. Cl.[5] ..... E03D 1/00; E03D 3/00; E03D 5/00

[52] U.S. Cl. ..... 4/300; 4/316; 4/420; 4/431

[58] Field of Search ..... 4/316, 431, 300, 354, 4/420, 661, 319–323, 432, 434–435, 437, 318

[56] References Cited

U.S. PATENT DOCUMENTS

| | | | |
|---|---|---|---|
| 2,858,939 | 11/1958 | Corlis | 4/320 X |
| 3,148,379 | 9/1964 | Muller | 4/420 |
| 3,733,617 | 5/1973 | Bennett | 4/320 X |
| 3,995,328 | 12/1976 | Carolan et al. | 4/316 |
| 4,275,470 | 6/1981 | Badger et al. | 4/316 |
| 4,297,751 | 11/1981 | Olin et al. | 4/316 X |
| 4,357,719 | 11/1982 | Badger et al. | 4/323 X |
| 4,376,314 | 3/1983 | Iwans | 4/420 X |
| 4,376,315 | 3/1983 | Badger et al. | 4/316 X |
| 4,521,925 | 6/1985 | Chen et al. | 4/362 |
| 4,707,868 | 11/1987 | Hennessy | 4/354 X |
| 4,713,847 | 12/1987 | Oldfelt et al. | 4/316 |
| 4,783,859 | 11/1988 | Rozenblatt et al. | 4/316 |
| 4,819,279 | 4/1989 | Sigler et al. | 4/362 |

*Primary Examiner*—Henry K. Artis

[57] ABSTRACT

A vacuum flush water closet having the bowl, rim and pedestal made of china. The water closet has a self contained flushing water dispensing valve and sewage discharge valve control system operatively mounted around and under the bowl. The water closet is secured to the floor/deck by use of a base mounting plate. The sewage discharge valve is fixedly secured to the underside of the bowl and the said valve is manually opened and spring closed. Flushing water is supplied through a flexible flush tube mounted around the underside of the upper rim of the bowl. The flushing water is directed by a vacuum operated water dispensing valve. The operation of the water dispensing valve is controlled by a 3-way vacuum switch. The sewage discharge valve is manually operated by a foot pedal mounted below and in front of the bowl. The duration of the sewage discharge valve opening time is controlled by the manual operation and release of the foot pedal. The flushing water volme is limited by a programmed operation of the water dispensing valve and operates independently of the sewage discharge valve opening time.

14 Claims, 4 Drawing Sheets

MANUALLY OPERATED VACUUM FLUSH WATER CLOSET

BACKGROUND OF THE INVENTION

1. Field of the Invention

The present invention relates to the art of sanitary plumbing systems and more particularly to a novel and improved vacuum flush water closet.

2. Description of the Relevant Art

Vacuum flush sewage systems have been provided heretofore, but they have inherent disadvantages. Some disadvantages of some prior art vacuum flush water closets are that they are expensive, large size, complex and, to varying degrees, difficult to service. Another disadvantage of the prior art vacuum flush water closets is that, they incorporate control systems which are slow and inefficient in operation. A further disadvantage of some prior art water closets is, under certain circumstances, it is possible to actually create a vacuum lock in the bowl with the inherent and potential risk to the user.

SUMMARY OF THE INVENTION

In view of the foregoing, it is the purpose of the present invention to provide a novel and improved vacuum flush water closet excluding the aforementioned disadvantages of the prior art vacuum flush water closets.

A further objective of the present invention is to provide a novel and improved vacuum flush water closet which possesses the virtue of simplicity, compactness, reasonably lightweight, economic to produce and efficient in operation.

A further objective of the present invention is to provide a novel and improved vacuum flush closet that will prevent a vacuum lock within the bowl should the upper opening be sealed during a flush cycle.

A further objective of the present invention is to provide a novel and improved vacuum flush water closet incorporating a self contained water dispensing valve and sewage discharge valve control system operatively mounted around and below the bowl.

A further objective of the present invention is to provide a novel and improved vacuum flush water closet having a manually operated sewage discharge valve which is fixedly attached below the bowl. A pivotal lever connected to the sewage discharge valve extends through an opening in the front of the bowl pedestal. The water closet is attached to a base mounting plate which in turn is secured to the floor/deck. A water dispensing valve is operatively mounted on the bowl. A normally closed three-way vacuum switch is operatively mounted below the bowl controlling the flushing water through the water dispensing valve.

A further objective of the present invention is to provide a novel and improved vacuum flush water closet having a sewage discharge valve that is manually operated by a foot pedal extending forwardly from the front of the bowl pedestal. The pedestal contains the operating mechanisms for the sewage discharge valve and a normally closed three-way vacuum switch.

A further objective of the present invention is to provide a novel and improved vacuum flush water closet which is individually controllable for regulating the sewage discharge valve opening time of the overall flushing cycle without increase in water consumption.

A further objective of the present invention is to provide a novel and improved vacuum flush water closet which includes a manually operable sewage discharge valve, a bowl having an outlet aperture at the lower end thereof which is operatively connected to the sewage discharge valve, the bowl having an open upper end with the rim therearound, a hinged seat operatively mounted on the rim, a flushing water dispensing valve operatively mounted on the bowl for directing a limited volume of water into the bowl, a manually operated foot pedal for controlling the sewage discharge valve opening and a three-way vacuum switch for enabling vacuum operation of the water dispensing valve.

Other features and advantages of this invention will be apparent from the following detailed description, appended claims and the accompanying drawings.

DESCRIPTION OF THE PREFERRED EMBODIMENT

Figure 1:
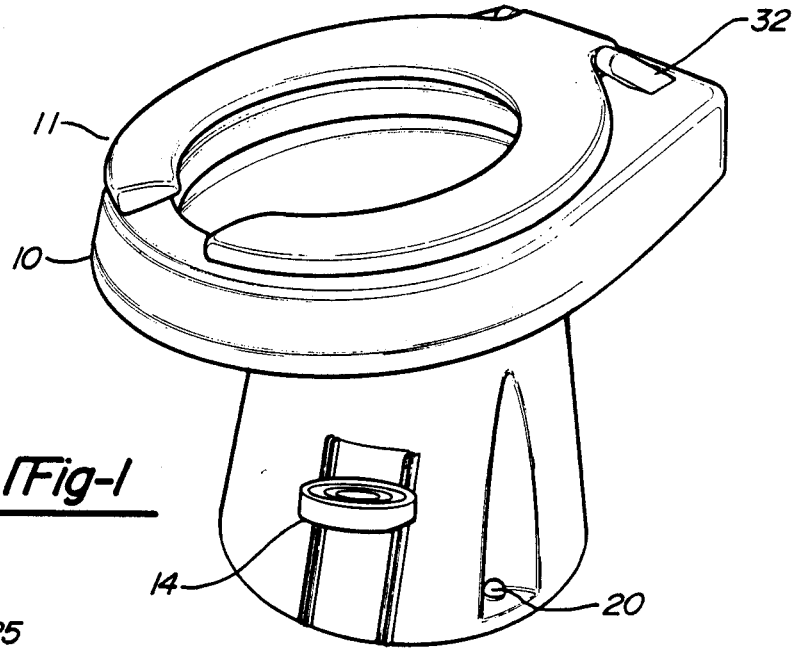
FIG. 1 is a three dimensional representation of the vacuum flush toilet showing the foot pedal in the up position.
Figure 2:
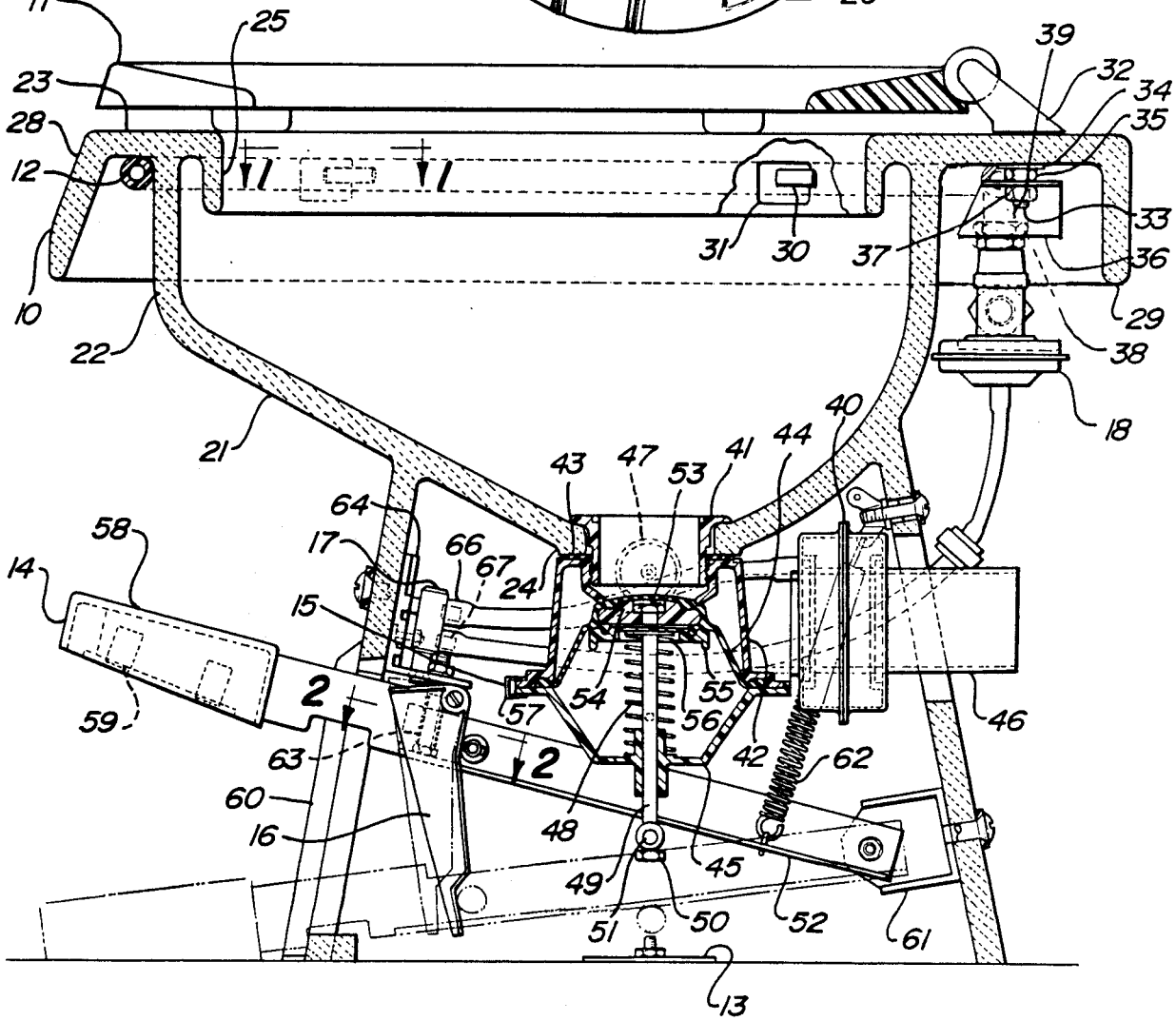
FIG. 2 is a sectional side elevation of the toilet shown in FIG. 1; the section plane runs through the centerline of the toilet with the exception the foot pedal which is shown rotated 30 degrees out of its true position.
Figure 3:
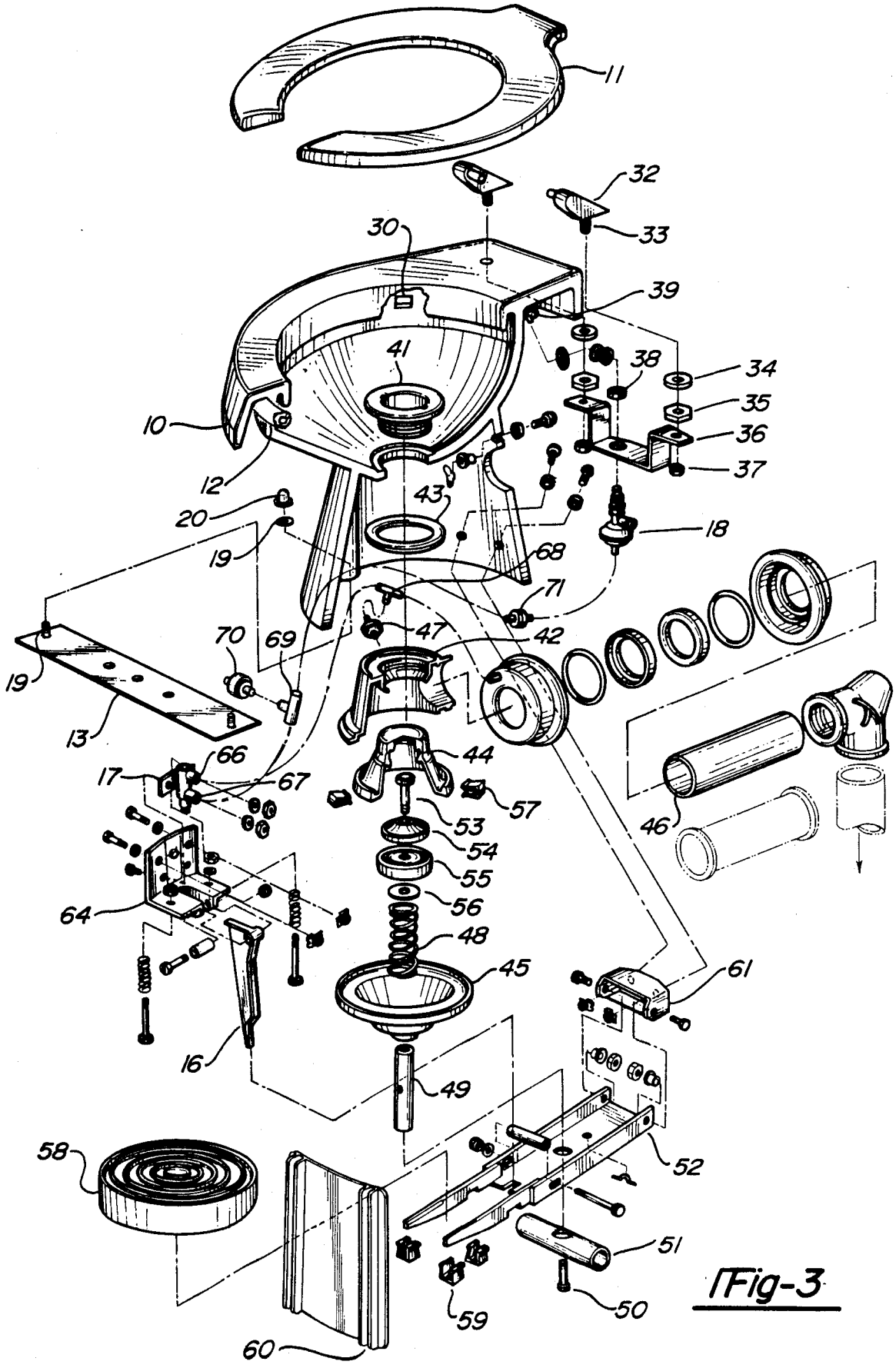
FIG. 3 is an exploded view of the toilet. The components are shown separated to aid in assimilation of the overall design.
Figure 4:
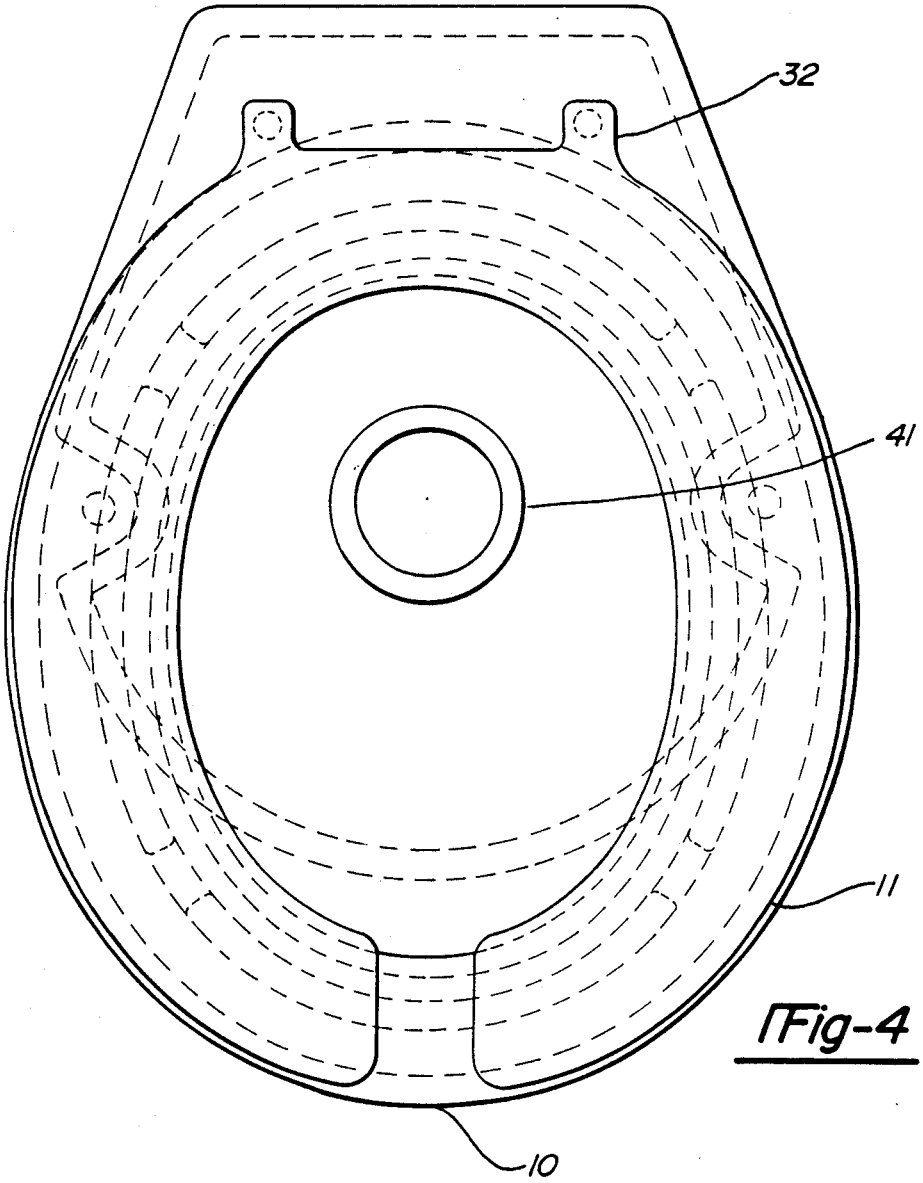
FIG. 4 is a plan elevation of the toilet shown in FIG. 1.

Referring to the drawings and particularly FIGS. 1, 2, and 3, an illustrative vacuum flushing water closet embodiment of the invention's shown which comprises a bowl, generally indicated by the numeral 10, on which is operatively mounted a conventional toilet seat, generally indicated by the numeral 11. The toilet seat may be made from any suitable material such as plastic or wood. As shown in FIGS. 2 and 3, the water closet (or toilet) of the present invention includes a flushing water spray ring, generally indicated by the numeral 12, which is mounted around the upper rim of the bowl 10. The bowl 10 is secured in place, as more fully described hereinafter, on a base mounting plate generally indicated by the numeral 13. The base mounting plate 13 may be of any suitable material such as steel or aluminum.

As shown in FIGS. 1, 2, and 3, the water closet of the present invention is provided with a foot pedal, generally indicated by the numeral 14, which manually opens the sewage discharge valve 15. The foot pedal 14 extends from the pedestal portion of the bowl 10 and projects outwardly and slightly to one side of the centerfront at an angle of approximately 30 degrees. The foot pedal 14 is attached directly to the sewage discharge valve generally indicated by the numeral 15.

The foot pedal 14 also strokes a cam 16 which initiates a flushing cycle by depressing a three-way vacuum switch 17. The three-way vacuum switch 17 is operatively connected to the water dispensing valve 18. The flushing water supply is controlled by the water dispensing valve 18.

The bowl 10 is a one piece china construction, the bowl interior having a minimum surface area consistent with the optimum shape and the maximum volume. Maintaining a minimum interior surface area for the bowl 10 allows the limited quantity of flush water to achieve the maximum possible cleansing action. The interior-exterior surfaces of the bowl 10 are finished in a hard smooth coating such as a vitrified porcelain and may be supplied in a variety of colors.

Figure 7:
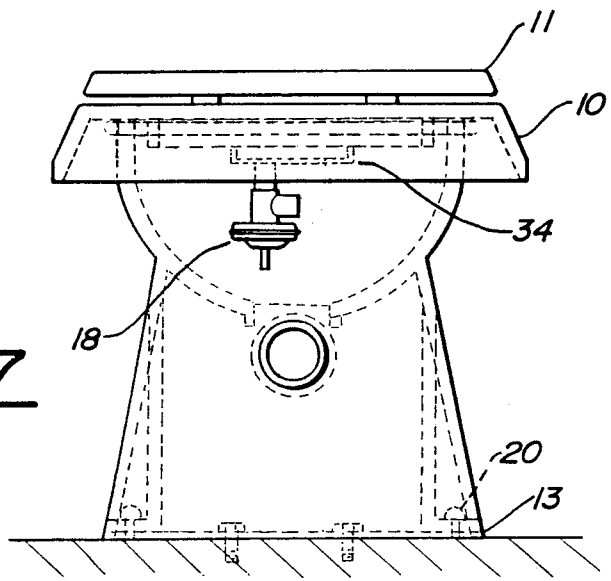
FIG. 7 is a reduced scale rear elevation of the toilet shown in FIG. 1. The view includes the water dispensing valve and some waste pipe orientation choices.

As illustrated in FIGS. 2, 3 and 7, the bowl 10 is releasably secured to the base mounting plate 13 by two threaded studs attached to the base mounting plate and bolted through the china base of the pedestal portion of the bowl. The base mounting plate 13 may be attached to the floor/deck by bolting or welding.

As shown in FIG. 2 the bowl 10 includes a body portion 21 which has formed around the upper end thereof a circumferentially extended vertical wall portion 22 which is surmounted by a horizontal surface 23. The lower end of the bowl body 21 terminates in a discharge hole as indicated by the numeral 24.

The upper horizontal surface 23 further includes an inner peripheral wall 25 which is integrally formed at its upper end with the horizontal surface. It can be noted that the inner vertical wall 25 is spaced inwardly from the bowl wall 22 to form a constant width groove around the inner periphery of the bowl.

The aforementioned groove serves as a concealment for the spray ring outlet nozzles 30, strategically located around the inner rim of the bowl. The rim 23 further includes an outer peripheral wall 28, which slopes outwardly and downwardly to a rounded edge 29.

Figure 5:
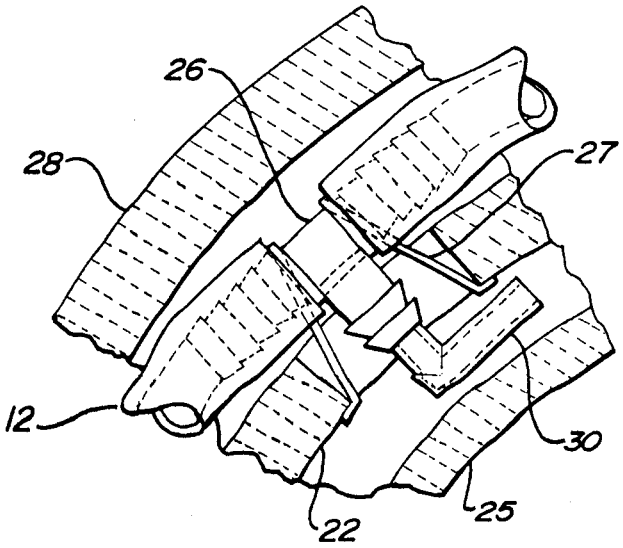
FIG. 5 is a fragmentary, enlarged sectional plan view of one of the rim flushing water nozzles illustrated in FIG. 2 taken along line 1—1.

As shown in FIGS. 2 and 5, the spray ring 12 is located in the outer pocket formed by the vertical walls 22 and 28, and the enclosing top surface 23. The spray ring may be formed of flexible tubing such as reinforced vinyl hose and be of adequate size to accommodate the required flow rate. The spray ring 12 includes a plurality of nozzles 30 strategically located around the bowl 10. The nozzles project through oversized rectangular access holes 31 located in the vertical wall 22. Each nozzle is inserted in a tee 26 and each tee is inserted in the spray ring 12 forming an integral water tight conduit. Each nozzle 30 is securely held in position by individual spring clips 27 that snap in place through the rectangular access holes 31. The nozzles 30 may be rotated 180 degrees or more to direct the water flow as desired. As shown in FIG. 2, the nozzles 30 can be oriented in a common direction so that the ejecting flushing water creates a swirling pattern within the bowl 10 scouring the surface with a more effective cleansing action.

As shown in FIGS. 1 and 2, the toilet seat 11 is fitted with a plurality of bumpers to maintain an opening and seat support, the seat shown is of the open front type less cover, although a conventional seat is acceptable, As illustrative in FIG. 1 the toilet seat 11 is attached to the bowl 10 by a pair of hinges located at the rear of the seat. As shown in FIG. 2 each hinge 32 includes a threaded shaft 33 that extends through the china surface 23. Each shaft is secured to the china surface 23 by washer 34 and nut 35. Also attached to the shafts 33 is the water dispensing valve bracket 36 which is fastened to the shaft 33 by an additional nut 37.

As shown in FIGS. 2 and 3, the water dispensing valve 18 is inserted through the water dispensing valve bracket 36 and secured in place with a jam nut 38. The water dispensing valve 18 may be rotated 180 degrees or more to accommodate the flush water supply line orientation. The water dispensing valve 18 is connected to the spray ring 12 by a special tee with O-rings 29 which is self sealing and allows the water dispensing valve 18 to be swiveled to suit the flush water supply line orientation previously noted. As shown in FIGS. 2 and 3, the sewage discharge valve 15 is attached to the bowl 10 by the threaded spigot 41 which is inserted downwardly through the bowl and screwed into the top cap 42. A bowl neck seal 43 is situated between the top cap 42 and the bowl 10 maintaining a leak tight seal when the threaded spigot 41 is tightened in place.

As shown in FIGS. 2 and 3, the sewage discharge valve, generally indicated by the numeral 15, comprises the following major items; top cap 42, flexible diaphragm 44, bottom cap 45, exit pipe 46, a torus shaped vacuum reservoir 40, that slides over and seals around the exit pipe 46 and a check valve 47. The diaphragm 44 is the seal between the vacuum source and the bowl 10. Diaphragm 44 seals against the inner rim of the top cap 42 and is held in place by a helical compression spring 48. There also occurs a differential air pressure between the upper and lower surfaces of the diaphragm 44 which produces a net upward force augmenting the spring closure force on the seal. The outer lip of the diaphragm 44 has a circular bead and is secured in an annular recess between the horizontal flanges of the top cap 42 and 45 respectively and provide the clamping force to secure and seal the diaphragm outer edge.

As shown in FIGS. 2 and 3, the foot pedal, generally indicated by the numeral 14 is attached to the sewage discharge valve 15 by a bolt 50 and a support tube 51. The bolt 50 screws into the lower end of the guide rod 49, the upper end attached to the diaphragm 44. The diaphragm 44 has an inner annular bead which is secured between the valve seat 54 and the support collar 55, all three items are locked together by the bolt 53 which is threaded into the upper end of the support tube 44. A bearing washer 56 is inserted between the support collar 55 and the guide tube 49.

As shown in FIG. 2, the foot pedal generally indicated by the numeral 14 includes a flush pedal 58, flush arm 52 and shroud 60. The flush arm 52 is pivotally mounted to the hinge bracket 61 which in turn is bolted to the inner surface of the pedestal portion of the bowl 10. A helical tension spring 62 holds the foot pedal 14 in the raised position against a pair of adjustable spring loaded stops 63. The stops 63 are set so that the flush arm 52 in its raised position allows the diaphragm 44 to fully close without hindrance. In the down position the flush pedal 58 rests on the ground and the bolt 50 is adjusted by (screwing in or out) the guide rod 43. In the down position the diaphragm should be approximately 96% of its full downwards travel.

Figure 8:
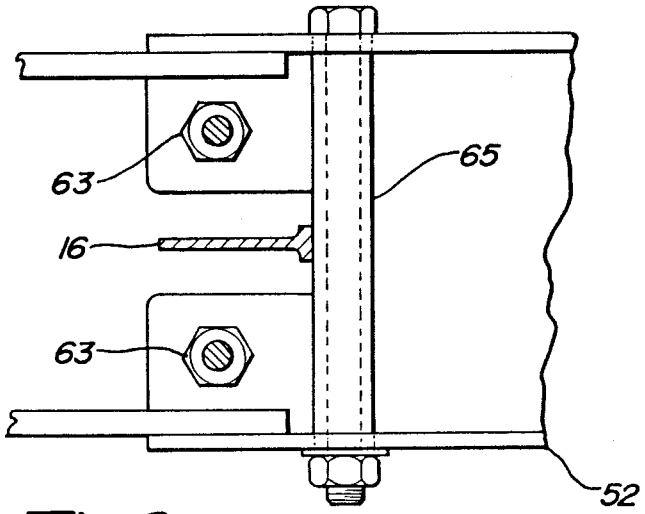
FIG. 8 is a fragmentary enlarged plan view of the flush lever and a cross section through the flush water cam illustrated in FIG. 2 taken along the line 2—2.

As shown in FIG. 2, the flush water cam 16 is pivotally mounted to the three-way switch bracket 64 which in turn is bolted to the inner surface of the pedestal portion of the bowl 10. The cam 16 is located in a slot cut in the web of the flush arm 52 as shown in FIG. 8. When the flush arm 52 rotates from the raised position to the down position the cam roller 65 strokes the cam 16.

As the cam roller 65 moves through its annular travel it causes the cam 16 to rotate a fixed amount. The cam roller 65 engages the cam 16 after the diaphragm 44 has traveled downwardly approximately 10% of its vertical travel. The cam roller 65 disengages from the cam at the end of its travel. On the upward return stroke, the cam roller 65 repeats the process of engaging and disengaging the cam 16.

Figure 6:
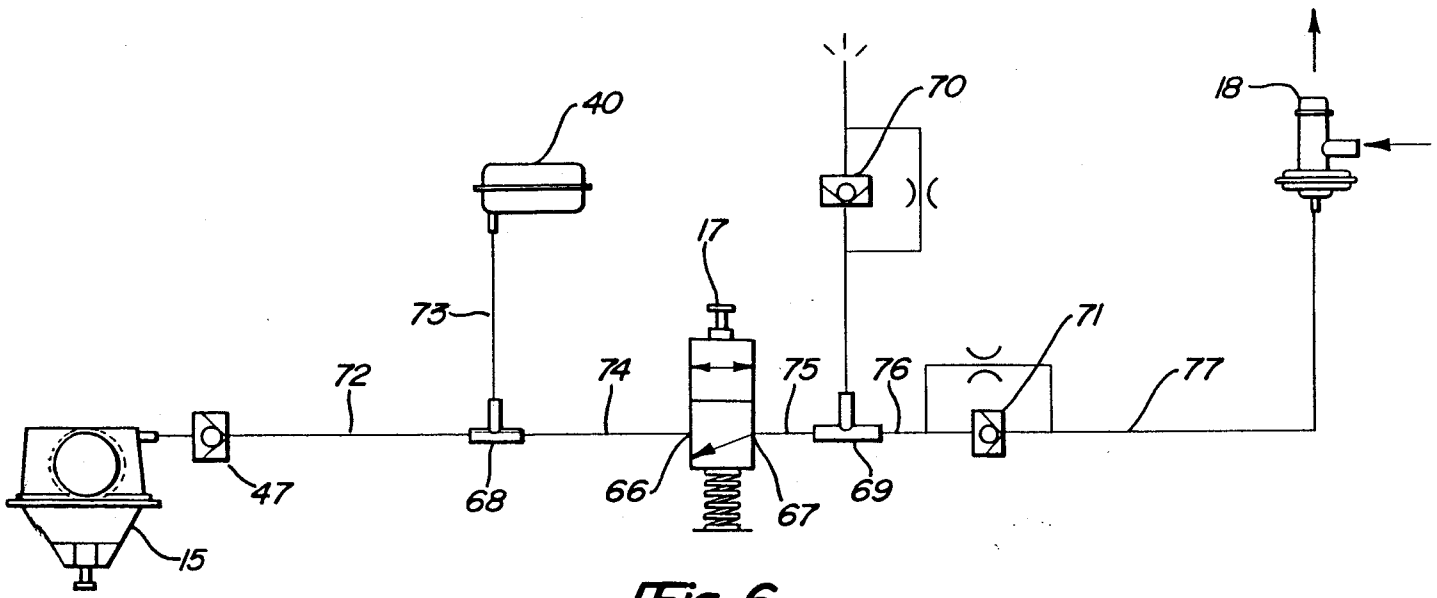
FIG. 6 is a schematic diagram of the toilet control system of the present invention.

As shown in FIG. 2, the three-way switch 17 is attached to the three-way switch bracket 64. The three-way switch 17 is a normally closed vacuum switch and is shown schematically in FIG. 6. The upper port 66 is connected to the vacuum source within the sewage discharge valve 15 through the check valve 47 and tee 68. A supplementary vacuum reservoir 40 is attached to the third port on the tee 68. The lower port 67 is connected to the water dispensing valve 18 through the bleeder check valve 71 and tee 69. It can be noted whereas a normal check valve allows free flow in one direction and no flow in the opposite direction; a bleeder check valve allows free flow in one direction and controlled flow (or bleed) in the opposite direction. When the cam 16 is depressed by the foot pedal, as previously described, the three-way vacuum switch 17 plunger connects the lower port 67 to the upper port 66. This creates a vacuum at the water dispensing valve 18 causing it to open and allowing water to flow to the bowl 10. When the cam 16 is released, the plunger of the three-way vacuum switch 17 returns to its at rest position and vents the line to the water dispensing valve 18 shutting off the water flow. All vacuum lines interconnecting and aforementioned components are of a flexible material such as a non-rigid vinyl and of a wall thickness capable of withstanding the collapsing pressures created by the internal vacuum. Typically, the bores are sized to allow adequate flow rates within the required response times and will be ⅛" int/dia to 3/16" int/dia.

In normal operation the water closet is flushed by depressing the foot pedal 14 to the floor, holding it momentarily (½ to 1 second) and then releasing it. The foot pedal 14 will return to its raised or up position automatically and the sewage discharge valve 15 will close isolating the bowl 10 from the vacuum source. When the foot pedal 14 is depressed to the floor the sewage discharge valve 15 is pulled open and the cam 16 depresses the three-way vacuum switch 17 during the pivoting of the flush arm 52. As can be noted in FIG. 6, source vacuum is present in the sewage discharge valve 15, in the components, 40, 47, 68 and the associated vacuum lines 72, 73 and 74. When the sewage discharge valve 15 is opened the vacuum level drops instantaneously and the check valve 47 prevents a similar loss of vacuum in the associated circuitry. The vacuum reservoir 40 maintains the level of vacuum necessary to operate the circuitry during the flush cycle. At the completion of the flush cycle the vacuum reservoir 40 is recharged by the vacuum source connected to the closed sewage discharge valve 15.

The dynamics of a normal flush cycle operates in the following prescribed manner. As the foot pedal 14 is depressed, the cam 16 holds open the three-way vacuum switch 17 allowing vacuum to the water dispensing valve 18. The water dispensing valve 18 opens and flush water flows into the bowl 10 through the spray ring 12. There is a residual volume of water in the bowl (1 pint approximately) from the previous flush and this exits the bowl 10 with the flushing water. When the foot pedal is fully depressed, the cam 16 is released and the three-way vacuum switch closes venting the vacuum lines and allowing the water dispensing valve 18 to return to its normally closed condition (shutting off the water). The bleeder check valve 71 delays vent air reaching the water dispensing valve momentarily during which period the flush water continues to flow depositing a further 1 pint and then shuts off. On the return or upward stroke of the foot pedal 14 the same procedure repeats in reverse with a residual 1 pint of flush water being deposited in the bowl 10 after the sewage discharge valve 15 closes at the completion of the upward stroke. A normal 3 pint flush comprises, 1 pint residual in the bowl 10 from the last flush, 0.5 pints on the down stroke and likewise on the up stroke and 1 pint when the foot pedal is fully down.

The dynamics of an irregular flush cycle are circumscribed as follows; if the foot pedal 14 is held down for an indefinite period the flush water will cease after an approximate total flow of 2.5 pints. That is made up of 1 pint residual water in the bowl 10 prior to the flush, 0.5 pints as the cam 16 is actuated by the downward stroke of the flush arm 52 and the final 1 pint delivered by the delayed closure of the water dispensing valve 18 as heretofore described. This is a delayed shutoff and prevents a continuous discharge of water. When the foot pedal 14 is released, the flush will complete its normal cycle; that is 0.5 pints will flow on the upstroke and a final 1 pint delivery to the bowl preparatory to the next flush. If the foot pedal 14 is stopped in mid-stroke, (that is at some position between the full up and the full down position), the three-way vacuum switch 17 will remain in the open (unvented) position. The water dispensing valve 18 will continue to flush water through the bowl 10 until the bleeder check valve 70 exhausts the vacuum reservoir 40. When the vacuum reservoir 40 is exhausted the water dispensing valve will close. The bleeder valve 70 has a controlled air flow orifice that is too slow to affect normal flush operations, but will terminate the flush if the three-way vacuum switch 17 is held open for an abnormally long period. This is described as a limiting shutoff and the present bleeder check valve 70 has fixed orifice that will exhaust the vacuum reservoir in approximately 5 seconds, although this can be varied by changing the orifice in the bleeder check valve 70.

Although the preferred embodiment of the invention herein disclosed will perform in the manner prescribed it is subject to improvements and/or revisions. Therefore, the present embodiments are to be considered indicative of and not restricting in the scope of the invention. The appended claims define the specifics of the invention and any and all changes that may be incorporated which fall within the meaning and intent of equivalency of the claims are intended to be included herein.

The following claims are advanced in support of the preferred embodiment of the invention and for which an exclusive property and privilege is considered appropriate.

I claim:

1. A vacuum flush water closet, comprising:

a bowl having a discharge opening at the lower end and an open upper end with a rim circumventually about said upper end, a support base integral with said bowl between said upper end and said discharge opening and substantially enclosing said discharge opening;

a vacuum source;

a sewage discharge valve interconnected between said vacuum source and said discharge opening;

a flush lever pivotally mounted at the lower rear end of said support base, said flush lever operatively connected to said sewage discharge valve;

a seat mounted on the top surface of said rim;

a vacuum controlled water supply means controlled by said flush lever;

said water supply means including a spray ring mounted around the outside of said rim about the open upper end of said bowl; said rim comprising a horizontal surface and includes a first downwardly extending portion inside the circumference of said bowl and a second downwardly extending portion outside of the circumference of said bowl, each said first and second portion forming a respective first and second downwardly facing annular recess; said spray ring releasibly mounted in said second angular recess; water nozzles extending through apertures in said bowl and into said first angular recess; and a vacuum control system including a 3-way vacuum switch for operating and controlling the flush operation of said water closet.

2. The water closet of claim 1, wherein:

a means for supporting said water closet includes a mounting plate and means for securing said water closet to said mounting plate; and said mounting plate being secured to the adjacent structure.

3. The water closet of claim 2, wherein:

said bowl, said rim and said support base are made of china.

4. The water closet of claim 3, wherein:

a vacuum operated water dispensing valve connected to said spray ring and to a source of water; and said water dispensing valve operatively controlled by said vacuum control system.

5. The water closet of claim 4, wherein:

said flush lever activates said 3-way vacuum switch which activates said water dispensing valve.

6. The water closet of claim 5, wherein:

said spray ring comprises a flexible tube assembly including a plurality of rotatable water nozzles selectively directed around said rim.

7. The water closet of claim 4, wherein:

said apertures prevent a vacuum within said bowl when said discharge valve is open to the vacuum source.

8. The water closet of claim 7, wherein:

said sewage discharge valve is threadedly mounted beneath said discharge opening; and said discharge valve includes a valve seat and diaphragm for sealing said bowl from said vacuum source.

9. The water closet of claim 8, wherein:

said discharge valve includes a valve stem mounted centrally below said valve seat; and said diaphragm is connected to said flush lever.

10. The water closet of claim 9, wherein:

said valve stem and said diaphragm are moved to an open position by the movement of said flush lever downward;

when said flush lever is released, spring means returns said lever to its upper position; and said lever returns said diaphragm to its closed position.

11. The water closet of claim 10, wherein:

said discharge valve includes a vacuum chamber separated from said bowl by said valve seat and said diaphragm when in said closed position; and said vacuum chamber is connected to a vacuum source external of the water closet.

12. A vacuum flush water closet, comprising:

a bowl having a discharge opening at a lower end and an open upper end, said upper end including a rim;

said rim comprising a horizontal surface and includes a first downwardly extending portion inside the circumference of said bowl and a second downwardly extending portion outside of the circumference of said bowl, each said first and second portion forming a respective first and second downwardly facing annular recess; a spray ring releasibly mounted in said second angular recess;

said discharge opening sealingly engaged by a discharge valve that is manually operated to an open position and returned to a sealed position by a spring means;

a seat mounted on said rim;

a water dispensing valve for supplying flushing water to said bowl by way of said spray ring, a flush lever mounted below said bowl and operatively connected to said discharge valve;

said water dispensing valve controlled by the operation of said flush levers;

a first shut-off means for delaying the deposition of a volume of flushing water to said bowl when said flush lever reaches its full extent; and a second shut-off means for eliminating the amount of flushing water released should said flush lever be prevented from reaching its full extent.

13. The water closet of claim 12, wherein:

a 3-way vacuum switch operatively connected to said flush lever and said dispensing valve such that operation of said lever prevents said flushing water from entering said bowl;

when said flush lever reaches its full extent, said vacuum switch will reach ambient and allow air to said dispensing valve through a bleeder check valve, said bleeder check valve delaying the closing of said dispensing valve;

when said lever is released, a spring means returns said lever to its uppermost position, said lever activating said vacuum switch; and an additional bleeder check valve between said vacuum switch and said dispensing valve such that said dispensing valve will be closed when said lever is held for an extended period of time.

14. A control system for a water closet having a bowl with an externally mounted spray ring attached thereto, a rim composite with said bowl, a vacuum source, vacuum operated water dispensing valve, and a manually operated discharge valve, wherein.

said rim comprising a horizontal surface and includes a first downwardly extending portion inside the circumference of said bowl and a second downwardly extending portion outside of the circumference of said bowl, each said first and second portion forming a respective first and second downwardly facing annular recess; said spray ring releasibly mounted in said second angular recess and having water nozzles extending through apertures in said bowl and into said first annular recess; said control system comprising a 3-way vacuum switch connected between said vacuum source and said dispensing valve;

means for operating said vacuum switch to activate said dispensing valve;

a vacuum reservoir;

a first bleeder check valve connected to said vacuum switch and said dispensing valve to delay closure of said dispensing valve; and a second bleeder check valve to insure closure of said dispensing valve and limit the amount of water that dispenses in said bowl.

* * * * *